US012709958B2

(12) United States Patent
Wang

(10) Patent No.: US 12,709,958 B2
(45) Date of Patent: Aug. 18, 2026

(54) PLUGGING DEVICE

(71) Applicant: SICHUAN AMOS PETROLEUM ENGINEERING TECHNOLOGY CO., LTD, Xi'an (CN)

(72) Inventor: Han Wang, Xi'an (CN)

(73) Assignee: SICHUAN AMOS PETROLEUM ENGINEERING TECHNOLOGY CO., LTD, Xi'an (CN)

( * ) Notice: Subject to any disclaimer, the term of this patent is extended or adjusted under 35 U.S.C. 154(b) by 0 days.

(21) Appl. No.: 19/119,718

(22) PCT Filed: Sep. 13, 2023

(86) PCT No.: PCT/CN2023/118468
§ 371 (c)(1),
(2) Date: Apr. 9, 2025

(87) PCT Pub. No.: WO2024/183259
PCT Pub. Date: Sep. 12, 2024

(65) Prior Publication Data

US 2026/0015919 A1 Jan. 15, 2026

(30) Foreign Application Priority Data

Mar. 7, 2023 (CN) ..... 202310207818.X
Mar. 17, 2023 (CN) ..... 202320522195.0

(51) Int. Cl.
*E21B 33/12* (2006.01)
*E21B 21/00* (2006.01)
*E21B 33/138* (2006.01)

(52) U.S. Cl.
CPC ..... *E21B 33/1208* (2013.01); *E21B 21/003* (2013.01); *E21B 33/138* (2013.01)

(58) Field of Classification Search
CPC .... E21B 33/13; E21B 33/138; E21B 33/1208; E21B 21/003
See application file for complete search history.

(56) References Cited

U.S. PATENT DOCUMENTS 7,896,068 B2 * 3/2011 Lee ..... C09K 8/467 166/66.5
7,931,089 B2 * 4/2011 Miller ..... C09K 8/805 428/407

(Continued)

FOREIGN PATENT DOCUMENTS

AU 2017379410 A1 7/2019
CN 103362471 A 10/2013

(Continued)

OTHER PUBLICATIONS

International Search Report Issued in International Patent Application No. PCT/CN2023/118468, dated Nov. 23, 2023 (8 Pages) [English Translation].

(Continued)

*Primary Examiner* — Yong-Suk (Philip) Ro
(74) *Attorney, Agent, or Firm* — Nixon Peabody LLP

(57) ABSTRACT

A plugging device includes a wrapping body, the wrapping body includes a flexible outer wall and a rigid body located inside the wrapping body, a filler is arranged in a remaining space, other than a space occupied by the rigid body, in the wrapping body; and the filler has fluidity. The plugging device can better cover, fill and plug special-shaped holes, and the deformed wrapping body will fill an inlet of a perforation hole and will not easily fall off without a pressure difference.

9 Claims, 3 Drawing Sheets

(56) References Cited

U.S. PATENT DOCUMENTS

| | | | | |
|---|---|---|---|---|
| 8,631,876 | B2 | 1/2014 | Xu et al. | |
| 2014/0284063 | A1* | 9/2014 | Fripp | E21B 29/00 166/376 |
| 2015/0060069 | A1 | 3/2015 | Potapenko et al. | |
| 2018/0258340 | A1* | 9/2018 | Rothrock | C09K 8/58 |
| 2018/0346800 | A1* | 12/2018 | Fu | C09K 8/608 |

FOREIGN PATENT DOCUMENTS

| | | | |
|---|---|---|---|
| CN | 103502563 | A | 1/2014 |
| CN | 108625832 | A | 10/2018 |
| CN | 111909674 | A | 11/2020 |
| CN | 112280545 | A | 1/2021 |
| CN | 213144454 | U | 5/2021 |
| CN | 214616484 | U | 11/2021 |
| CN | 113755145 | A | 12/2021 |
| CN | 114426820 | A | 5/2022 |
| CN | 114921238 | A | 8/2022 |
| CN | 115141614 | A | 10/2022 |
| CN | 115612468 | A | 1/2023 |
| CN | 218324812 | U | 1/2023 |
| CN | 116335578 | A | 6/2023 |
| CN | 219452055 | U | 8/2023 |
| WO | 2018112508 | A1 | 6/2018 |

OTHER PUBLICATIONS

IPRP for International Application No. PCT/CN2023/118468, dated Jun. 26, 2025 (4 Pages) (English Translation).

First Office Action in Chinese Application No. 202310259760.3, dated Apr. 18, 2025 (6 pages) (English Translation).

IPRP for International Application No. PCT/CN2023/118468, dated Jun. 26, 2025 (8 Pages) (with English Translation).

* cited by examiner

PLUGGING DEVICE

CROSS-REFERENCE TO RELATED APPLICATIONS

This patent application is a U.S. national stage application of International Patent Application No. PCT/CN2023/118468, filed Sep. 13, 2023, which claims the benefit of and priority to Chinese Patent Application No. 202310207818.X, filed Mar. 7, 2023, and Chinese Patent Application No. 202320522195.0, filed Mar. 17, 2023, each of which is hereby incorporated by reference herein in its entirety.

TECHNICAL FIELD

The present disclosure belongs to the technical field of oil and gas exploration and exploitation, and in particular to the field of plugging of perforation holes in fracturing construction during oil and gas exploration and development; and in particular to a plugging device.

BACKGROUND

In the process of oil and gas field exploration and development, large-scale hydraulic fracturing is an important means of increasing production. The principle thereof is that sand-carrying fluid is driven by a plunger pump on the ground. The sand-carrying fluid flows inside the casing towards the perforation holes under the action of the plunger pump, and a large amount of sand-carrying fluid is injected into the formation through perforation positions. The formation generates fractures under the action of the great pressure of the fluid, and at the same time, these fractures cannot be closed under the support of sand particles (propping agents) in the fluid. These unclosed fractures endow the formation with better rock physical properties (such as porosity, etc.), thus enabling the oil and gas wells to obtain a better oil and gas production capacity. In the specific fracturing construction process, fracturing construction is carried out in stages. Usually, each well will carry out several or dozens of fracturing operations according to different conditions. Each fracturing stage contains dozens to hundreds of different perforation positions. These perforation positions are oil, gas and water channels that are formed by perforating tools penetrating the casing wall and the cement sheath to connect the wellbore and the formation. The common fracturing operation procedure is as follows: perforating the first stage-fracturing the perforation positions of the first stage-plugging the perforation positions of the first stage-perforating the second stage, fracturing the perforation positions of the second stage, and plugging the perforation positions of the second stage . . . and so on until the fracturing operation of the entire well is completed.

In the specific fracturing construction process, before carrying out the fracturing construction of the next stage, it is necessary to temporarily plug the perforation holes of the previous stage for which the fracturing construction has been completed. The specific method is to put perforation hole plugging devices at the wellhead before fracturing, and then start the plunger pump to pump the fluid into the wellbore. The fluid carries the perforation hole plugging device to the underground perforation holes. During the fracturing operation, the high-pressure fluid will generate a pressure difference at both sides of the plugging device, that is, the pressure at the side exposed to the wellbore is higher than the pressure at the side exposed to the perforation holes.

This pressure difference keeps the perforation hole plugging device always at the entrance of the perforation holes, so that the fluid cannot enter the plugged perforation hole, achieving the purpose of plugging the perforation hole. Currently, there are two types of perforation hole plugging technologies that are similar to the objective of the present disclosure, namely, fracturing temporary plugging balls and fracturing temporary plugging knots.

The fracturing temporary plugging balls are usually solid or hollow elastic or rigid spheres or quasi-spheres made of a single soluble or insoluble material with a relatively smooth surface and a diameter slightly larger than the diameter of the perforation hole. When in use, the temporary plugging balls whose number is equal to the expected number of the plugging perforation holes are put into the wellhead, and then the plunger pump on the ground is started to inject fluid into the well. The temporary plugging balls are carried to the perforation holes with the fluid, and are plugged at the perforation holes under the action of the fluid during fracturing operation, thus achieving the effect of plugging the perforation holes.

However, the temporary plugging ball cannot be fixed at the inlet of the perforation hole. Without enough pressure difference, the ball will be separated from the inlet of the perforation hole, move freely with the fluid under the action of gravity and buoyancy, and may plug the new perforation hole that has not been fractured with a certain probability. Some perforation holes will show irregular shapes, such as oval, bullet-shaped, rectangular, trapezoidal and so on, due to the incident angle of the perforating bullets and high-pressure fluid washing. The temporary plugging ball in the prior art cannot completely cover the perforation hole with irregular shape, resulting in a poor plugging effect of the fracturing temporary plugging ball on the perforation hole with irregular shape.

Fracturing temporary plugging knots are used, which are usually made by tying a knot with a rope-like product made of a single soluble material. The structure includes a knot, which includes two or more tail fins at both ends, with a diameter slightly larger than the diameter of the perforating hole and a thin-walled ball shell for wrapping the knot so as to be matched with a automatic ball injector on the ground. When in used, the fracturing temporary plugging knots are put into the wellhead, and then plunger pump on the ground is started to inject fluid into the well. The thin-walled ball shell will be broken in the collision with the well wall, and the temporarily plugging knot will break out of the shell and float to the perforation hole with the fluid. During fracturing operation, the temporarily plugging knot will be plugged at the perforation hole under the action of the fluid, in which one end thereof is inserted into the perforation hole and the other end thereof is exposed to the wellbore, thus achieving the effect of plugging the perforation hole.

The fracturing temporary plugging knot cannot be fixed at the inlet of the perforation hole either. Without enough pressure difference, the knot will be separated from the inlet of the perforation hole, move freely with the fluid under the action of gravity and buoyancy, and may plug the next new perforation hole that has not been fractured with a certain probability, resulting in a poor construction effect. In addition, some perforation holes will show irregular shapes, such as oval, bullet-shaped, rectangular, trapezoidal and so on, due to the incident angle of the perforating bullets and high-pressure fluid washing. In order to achieve a good plugging effect in actual operation, more knots (the number of knots put in is greater than the number of perforation holes to be plugged) need to be put in, and the specific number needs to be determined according to the on-site situation, which requires higher on-site experience of operators, and also leads to a longer construction period and a higher cost. In addition, more freely movable knots also increase the probability that new perforation holes that have not been fractured are plugged by mistake.

Therefore, the main problems in the prior art are as follows. First, the plugging device cannot be matched with the shape of the perforation hole, resulting in a poor plugging effect. Second, the plugging device is prone to fall off, which leads to the plugging of the perforation hole that has just been perforated and has not been fractured by mistake.

SUMMARY

The present disclosure discloses a plugging device, which solves the problem that the plugging device in the prior art cannot be matched with the shape of a perforation hole so as to result in a poor plugging effect.

The plugging device of the present disclosure includes a wrapping body, the wrapping body includes a flexible outer wall and a rigid body; the flexible outer wall surrounds the rigid body; a filler is arranged in a remaining space, other than a space occupied by the rigid body, in the wrapping body; and the filler has fluidity.

In some embodiments, the plugging device includes multiple rigid bodies.

In some embodiments, fluff is formed on an outer wall of the wrapping body.

In some embodiments, the plugging device further includes a shell; the fluff and the wrapping body are arranged inside the shell, and the shell is configured to break when an external pressure is greater than 10 MPa.

In some embodiments, the shell is made of a plastic or polyglycolic acid material.

In some embodiments, the wrapping body, the fluff and the filler are made of soluble materials.

In some embodiments, multiple protrusions are formed on an surface of the wrapping body.

In some embodiments, multiple through holes are formed in the rigid body; and the multiple through holes are in communication with each other.

In some embodiments, a coating is arranged on an inner wall of each of the multiple through holes; and the coating has a property of swelling upon contact with water.

To sum up, the present disclosure achieves at least one of the following beneficial effects.

1. The plugging device of the present disclosure is put at the perforation hole or the plugging place, the rigid body is left outside, and the wrapping body is deformed under the action of the fluid pressure, so as to better fill the perforation hole or the plugging place, and better cover, fill and plug special-shaped holes such as oval, bullet-shaped, rectangular, trapezoidal and so on.
2. The fluff on the surface of the wrapping body fills the gap between the deformed wrapping body and the perforation hole under the action of the pressure. At this time, the deformed wrapping body and the fluff on the surface will be jointly inserted into and fill the inlet of the perforation hole, and the entire plugging device will be firmly stuck at the inlet of the perforation hole. In this way, the plugging device will not easily fall off without a pressure difference or even with a negative pressure difference, such as if the pressure of the perforation hole is greater than the pressure in the wellbore. The protrusions on the wrapping body can also play the role of auxiliary fixation.
3. The plugging device of the present disclosure is applied to the plugging of the perforation hole. One perforation hole only needs to be matched with one perforation hole plugging device of the present disclosure with a corresponding specification, which has low requirements on the corresponding on-site experience of operators, and does not need experienced people to analyze and judge the underground situation and throw more plugging devices, thereby avoiding a prolonged construction period and an increased cost.

The reference signs in the figure include: 1 shell; 2 fluff; 3 wrapping body; 4 filler; 5 rigid body; 6 through hole; 7 protrusion.

DETAILED DESCRIPTION OF THE EMBODIMENTS

The specific embodiments of the present disclosure will be described in further detail hereinafter.

In order to make the objectives, the technical scheme and the advantages of the present disclosure more clear, the technical scheme of the present disclosure will be clearly and completely explained in combination with the specific embodiments of the present disclosure and the corresponding drawings hereinafter. Obviously, the described embodiments are only part of the embodiments of the present disclosure, rather than all of the embodiments. Based on the embodiments in the present disclosure, all other embodiments obtained by those skilled in the art without paying creative labor belong to the scope of protection of the present disclosure.

First, a plugging device provided by this embodiment includes an wrapping body 3, the wrapping body 3 includes an outer wall made of a flexible material and a rigid body 5 located in the wrapping body 3; a filler 4 is arranged in the remaining space, other than a space occupied by the rigid body 5, in the wrapping body 3; and the filler 4 has fluidity. The filler 4 can be particle filler or fluid filler, and can also be a mixture filler of particles and fluid. In an alternative scheme, the particles are at least one of soluble magnesium alloy particles, PGA (polyglycolic acid) particles, soluble rubber, plastic particles and quartz sand; the fluid is liquid, and alternatively at least one of silicone oil and asphalt. Under the action of the pressure, the particles in the wrapping body 3 will be displaced inside the wrapping body 3, so that the wrapping body 3 will be deformed to adapt to the shape of the plugging opening. Similarly, the filler 4 that can deform the wrapping body 3 under the action of external force, regardless of the material, falls within the scope of protection of the present disclosure. Therefore, in a possible alternative to the filler 4, the filler 4 can also be gas.

Figure 1:
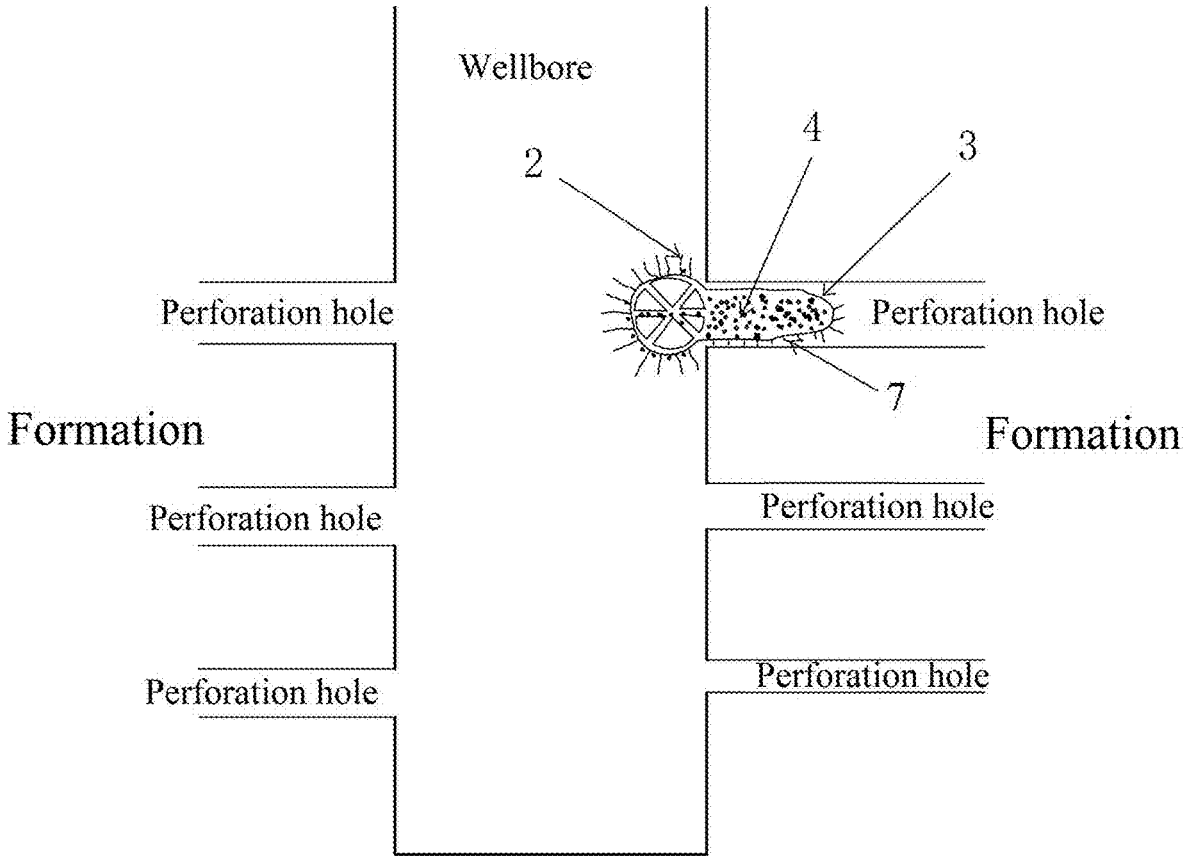
FIG. 1 is a schematic diagram of the state of an embodiment in the application of plugging a perforation hole.

As shown in FIG. 1, in the process of plugging the perforation hole, the size of the rigid body is set to be larger than the perforation hole. The rigid body 5 cannot pass through the perforation hole. Both sides of the rigid body 5 have a large pressure difference, so that the rigid body can be kept at the perforation hole. The rigid body 5 plays a major plugging role. The deformed wrapping body 3 can better adapt to the shape of the perforation hole and play an auxiliary plugging role, so that the plugging effect is better. When the pressure difference outside the perforation hole is reduced, the deformed wrapping body 3 can also play the role of fixing the rigid body 5 to prevent the device from falling off. The rigid body 5 can be a sphere, a cube or an irregular solid. The size of the rigid body 5 is larger than the caliber of the perforation hole. The rigid body 5 can be completely or mostly outside the perforation hole during the plugging process. Preferably, the rigid body 5 is a sphere, and the shape of the sphere is relatively uniform, so that it is more adaptable.

In a possible embodiment, there are multiple rigid bodies 5. The multiple rigid bodies 5 are used, which can also achieve a larger-area lateral plugging or a deeper longitudinal plugging of the perforation hole. When multiple rigid bodies 5 are used, a better plugging effect can be achieved by using a combination of rigid bodies 5 of different sizes. Specifically, the size of the larger rigid body 5 is larger than the caliber of the perforation hole. The size of the smaller rigid body 5 can be smaller than the caliber of the perforation hole. When the larger rigid body 5 covers the perforation hole, the smaller rigid body can seal the gap of the perforation hole laterally, or can enter the interior of the perforation hole to achieve multi-level plugging.

Multiple through holes 6 are formed in the rigid body 5. The through holes 6 are flow channels of the filler 4, so that the filler 4 can flow more smoothly, so that it is easier for the wrapping body 3 to deform. Preferably, the multiple through holes are in communication with each other. When the rigid body 5 is a sphere, the multiple through holes all pass through the center of the sphere. In a possible embodiment, an inner wall of the through hole 6 is provided with a coating. The coating has the property of swelling upon contact with water. Alternatively, the coating can be sodium acrylate, cross-linked sodium acrylate composite resin, polyvinyl alcohol, a polyurethane prepolymer, a modifier, etc. When water flows into the through holes, the coating swells upon contact with water, which can plug the return channels of the filler 4, prevent the deformation of the wrapping body 3 from recovery to some extent, and avoid the wrapping body 3 from falling off.

In a specific embodiment, multiple rigid protrusions 7 are formed on the surface of the wrapping body 3. The so-called rigid protrusions 7 are hard in texture, optionally, a PGA (polyglycolic acid) material, a plastic or a metal. After the wrapping body 3 is deformed to plug the perforation hole, the protrusions 7 can play the role of auxiliary fixation. When the external pressure decreases or disappears, the wrapping body 3 is prevented from falling off.

The surface of the wrapping body 3 is further provided with a lot of fluff 2 made of flexible materials. The fluff 2 can be in the shape of silk threads or rope heads. After the wrapping body 3 is deformed to plug the perforation hole, the fluff 2 can further plug the perforation hole, and of course, can also increase the friction between the wrapping body 3 and the perforation hole to further prevent the wrapping body 3 from falling off. In other possible embodiments, the fluff 2 can also be expressed in other ways. For example, when the fluff is expressed in the form of silk threads, one end of the silk thread is connected with the surface of the wrapping body 3. Alternatively, the flexible material of which the outer wall of the wrapping body 3 and the fluff 2 are made is a fiber material such as a high molecular polymer, for example, PGA (polyglycolic acid), plastic, rubber, cotton and linen, etc., which is directly molded or woven.

The plugging device further includes a shell 1. The shell 1 is made of a fragile material. The wrapping body 3 as well as the fluff 2 and the protrusion 7 on the outer surface of the wrapping body 3 are both arranged in the shell 1. The shell 1 is configured to protect the wrapping body 3 from being damaged during transportation and storage, and it is more convenient to take out and place the wrapping body. Because the wrapping body 3 is made of a deformable and flexible material, it is easy to be scratched during transportation and storage without the protection of the shell 1, and it is inconvenient to place a large number of wrapping bodies 3 in storage and use. Alternatively, the shell 1 is a thin plastic shell 1. Alternatively, the shell 1 is made of a polyvinyl alcohol material or a paper material.

Figure 2:
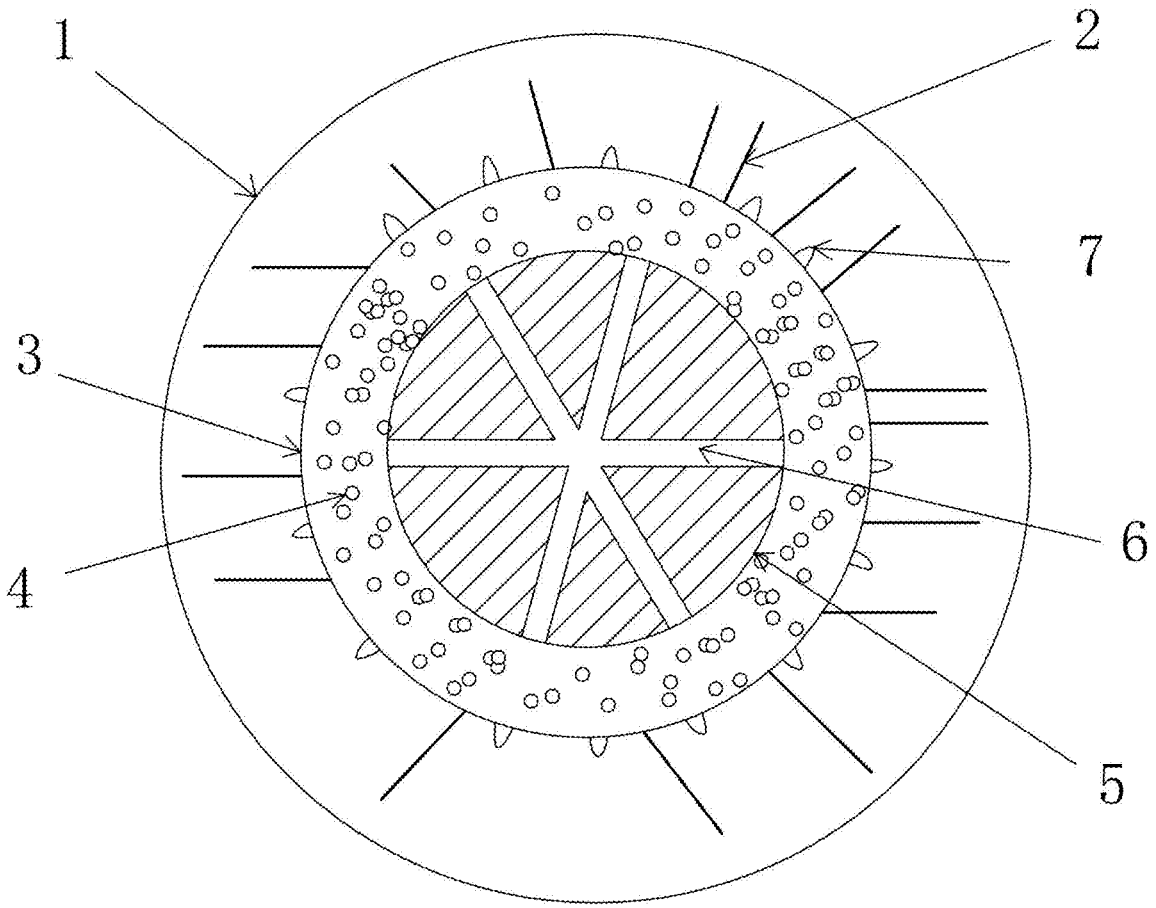
FIG. 2 shows a specific embodiment of a plugging device according to the present disclosure.

As shown in FIG. 2, this embodiment gives an example in which the entire wrapping body 3 is spherical. The plugging device includes a shell 1, a wrapping body 3, as well as fluff 2 and protrusions 7 formed on the wrapping body 3. The rigid body 5 is a sphere, and multiple through channels are formed therein. The spherical wrapping body 3 can be adapted to most of the perforation holes.

Figure 3:
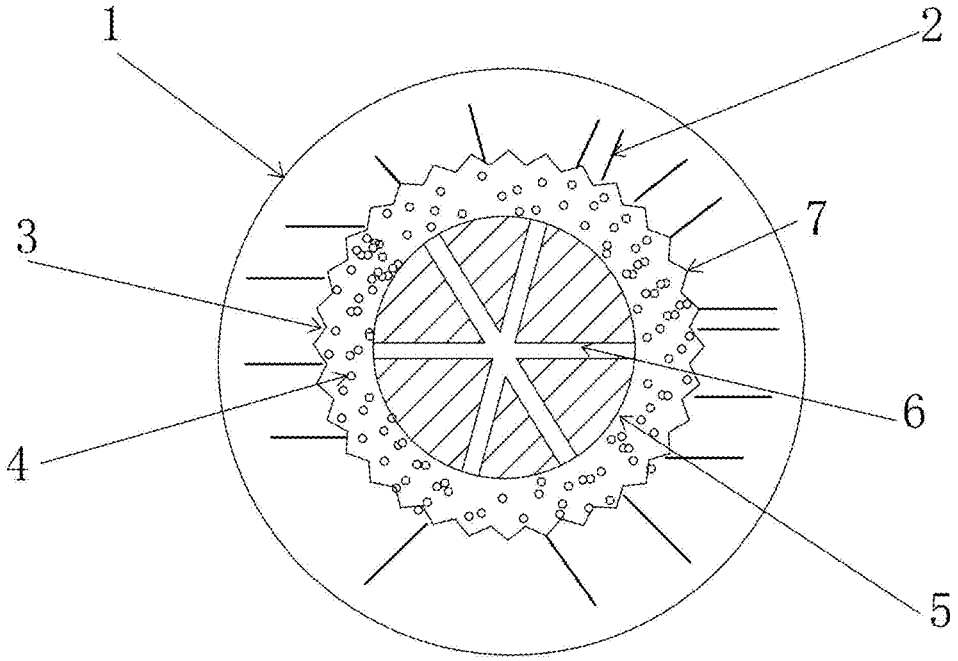
FIG. 3 shows another embodiment of a plugging device according to the present disclosure.

As shown in FIG. 3, this embodiment gives an example in which the wrapping body 3 is spherical and the cross section thereof is serrated. Compared with the simple spherical wrapping body 3, the wrapping body 3 with the serrated cross section has a greater friction when in use. In this embodiment, the protrusions 7 may not be used for further fixing.

Figure 4:
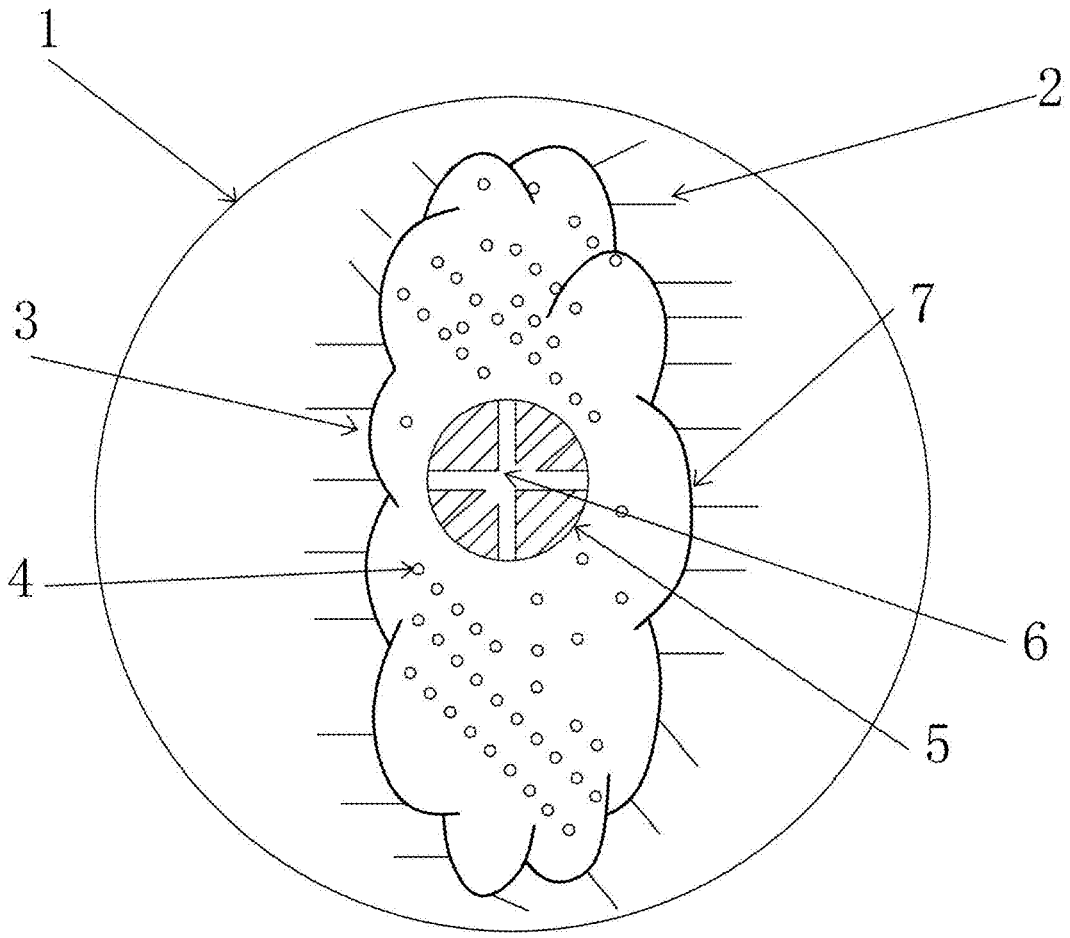
FIG. 4 shows yet another embodiment of a plugging device according to the present disclosure.

As shown in FIG. 4, this embodiment gives an example in which the wrapping body 3 is strip-shaped, and the overall shape thereof can be columnar, sea cucumber-shaped or shuttle-shaped. Compared with the wrapping body 3 with a spherical configuration, the strip-shaped wrapping body 3 can be more suitable for the shape of the perforation hole. When the wrapping body 3 reaches the perforation hole, the rigid body 5 first plugs the perforation hole. Under the action of the water flow and the pressure, the inner filler 4 moves from the side of the wrapping body 3 outside the perforation hole to the side of the wrapping body 3 inside the perforation hole under the action of the pressure, so that the posture of the wrapping body 3 is adjusted, finally the posture matched with the shape of the perforation hole is achieved, and the plugging effect is achieved.

Second, as shown in FIG. 1, this embodiment provides an application of the above plugging device in plugging perforation holes. The perforation hole is a perforation hole for fracturing construction of oil and gas exploration and development. In the process of oil and gas well exploration or construction, it is necessary to drill a vertical or obliquely downward or approximately horizontal wellbore from the ground, then place the casing, and fill the annular space between the casing and the well wall with cement. Thereafter, a perforating tool is transported to a predetermined depth by a cable or an oil tube, a perforating gun is activated, and the perforating bullet is fired to break through the casing and the cement sheath, resulting in a certain number of perforation holes to establish oil and gas channels between the wellbore and the perforation hole stratum position. If there are oil and gas resources at the perforation holes, the oil and gas resources will be ejected from the perforation holes and flow into the wellbore. The oil and gas resources are collected by using the wellbore.

In this embodiment, the wrapping body 3 needs to be made according to the size of the perforation hole. The size of the rigid body 5 inside the wrapping body 3 is slightly larger than that of the perforation hole, so that the rigid body 5 cannot pass through the perforation hole. In one possible embodiment, the size of the rigid body 5 plus the outer wall of the wrapping body 3 is only slightly larger than that of the perforation hole. During the plugging operation, the plugging device is put into the well through the ball injector. The fragile shell 1 is generally a thin plastic. Because it is difficult to inject objects with irregular and unsmooth surfaces by the ball injector on the ground, the shell 1 is used to wrap the outer sphere before use, so that the outer sphere can be conveniently injected by the ball injector on ground, for example, two hemispherical plastic shells 1 can be used as the fragile shell 1.

Because the underground pressure is usually as high as tens of MPa, hundreds of times higher than the standard atmospheric pressure, the fragile shell 1 is quickly broken under the action of the underground high pressure, and the wrapping body 3 carried therein will break out of the shell. When the wrapping body reaches the perforation hole, the wrapping body 3 is deformed and moved toward the side of the perforation hole under the pressure of the fluid pumped by the plunger pump. The internal rigid body 5 is stuck outside the perforation hole. The outer wall of the wrapping body 3 is made of a flexible material. When being squeezed by the pressure, the wrapping body 3 is deformed, a part of the fluff 2 is squeezed into the perforation hole, and another part of the fluff 2 is blocked out of the perforation hole. Both parts of the fluff 2 inside and outside the perforation hole can play the role of plugging the perforation hole. After the wrapping body 3 is deformed, most of the filler 4 is squeezed into the deformed body deep inside the perforation hole formed by the deformation of the wrapping body 3 through the through hole 6 of the rigid body 5. The deformed body goes deep into the perforation hole, which not only can play the role of plugging the perforation hole, but also can prevent the plugging device from falling off the perforation hole.

When multiple rigid bodies 5 are used, after the wrapping body 3 wrapping the rigid bodies 5 is squeezed and deformed, it is easier for the multiple rigid bodies 5 to change into multiple shapes, so as to plug the special-shaped perforation holes. When a typical perforation hole is plugged, the largest rigid body among the rigid bodies 5 is plugged outside the perforation hole, and the rest rigid bodies can enter the perforation hole with the deformed wrapping body 3 to plug the perforation hole.

In the case of permanent plugging, insoluble materials can be selected for production. The outer wall of the wrapping body 3 and the fluff 2 can be directly molded or woven with high molecular polymers such as Polypropylene (PP), Polyethylene (PE), Acrylonitrile Butadiene Styrene (ABS), Polyamide (PA), Polycarbonate (PC), rubber, cotton and linen. The rigid body 5 can be made of high molecular polymers such as PP, PE, ABS, PA, PC, metals and other rigid materials. The rigid body can prevent the device from completely sinking into the perforation hole, which will cause the formation to be exposed to high-pressure fluid and lead to plugging failure.

Under the application requirements of temporary plugging, the outer wall, the fluff 2, the rigid body 5 and the filler 4 of the wrapping body 3 are made of soluble materials. The term soluble means that the above parts is not solute immediately in the application environment of plugging the perforation hole, but usually is solute after a certain time, such as 48 or 72 hours. The PGA (polyglycolic acid) materials commonly used in the field can be selected.

In an embodiment, the filler 4 is a particle filler 4. The rigid body 5 is provided with multiple through holes 6. The diameter of the through hole 6 is larger than that of the particle filler 4. The inner wall of the through hole 6 can be provided with a layer swelling upon contact with water, which is made of sodium acrylate, cross-linked sodium acrylate composite resin, polyvinyl alcohol, a polyurethane prepolymer, a modifier, etc. In the present disclosure, the wrapping body 3 is prone to generate fractures after deformation. After water enters the wrapping body 3 through the fractures, the layer swelling upon contact with water slowly swells to plug the channel, so as to prevent particles from flowing back to the outside of the perforation hole.

After the wrapping body 3 is squeezed, the filler 4 can pass through the through hole 6, and directly reach the wrapping body 3 inside the perforation hole from the wrapping body 3 outside the perforation hole. More parts of the filler 4 enter the inside of the perforation hole. The through hole 6 makes it easier for the filler 4 to move from the outside of the perforation hole to the inside of the perforation hole when squeezed. Each through hole 6 is usually a straight line, and the orifices are distributed in different directions of the rigid body, so that the contact surface between the rigid body and the perforation hole can preferably have one or more through holes 6.

The hole plugging device with the deformable multilayer structure according to the present disclosure is used to better cover, fill and plug special-shaped holes such as oval, bullet-shaped, rectangular, trapezoidal and so on in the construction process.

The wrapping body 3 is deformed and goes deep into the perforation hole under the action of the fluid pressure, and the non-deformable part, such as the rigid body 5, remains outside the inlet of the perforation hole. The fluff 2 on the outer surface of the wrapping body 3 fills the gap between the deformed wrapping body 3 and the perforation hole under the action of the pressure. At this time, the deformed wrapping body 3 and the fluff 2 on the surface will be jointly fill the inlet of the perforation hole, and the entire plugging device will be firmly stuck at the inlet of the perforation hole. In this way, the plugging device will not easily fall off without a pressure difference or even with a negative pressure difference.

The foregoing is the preferred embodiments of the present disclosure. If the preferred examples in the preferred embodiments are not obviously contradictory or based on a certain preferred example, the preferred examples can be used in any combination. The embodiments and specific parameters in the embodiments are only for clearly expressing the inventing verification process of inventors, rather than limit the protection scope of the present disclosure. The protection scope of the present disclosure is still subject to the claims. All equivalent structural changes made by using the contents of the specification and drawings of the present disclosure shall, by the same token, be included within the scope of protection of the present disclosure.

What is claimed is:

1. A plugging device, comprising:

a wrapping body comprising a flexible outer wall, wherein the flexible outer wall surrounds a rigid body, and the flexible outer wall is more susceptible to deformation than the rigid body; and a filler arranged in a remaining space, other than a space occupied by the rigid body, in the wrapping body, wherein the filler has fluidity and is configured to be displaceable inside the wrapping body to deform the wrapping body under external force.

2. The plugging device according to claim 1, wherein the plugging device comprises a plurality of rigid bodies.

3. The plugging device according to claim 1, wherein fluff is formed on the flexible outer wall of the wrapping body.

4. The plugging device according to claim 3, further comprising a shell; wherein the fluff and the wrapping body are arranged inside the shell, and the shell is configured to break when an external pressure is greater than 10 MPa.

5. The plugging device according to claim 4, wherein the shell is made of a plastic or polyglycolic acid material.

6. The plugging device according to claim 3, wherein the wrapping body, the fluff and the filler are made of soluble materials.

7. The plugging device according to claim 1, wherein a plurality of protrusions are formed on an surface of the wrapping body.

8. The plugging device according to claim 1, wherein a plurality of through holes are formed in the rigid body; and the plurality of through holes are in communication with each other.

9. The plugging device according to claim 8, wherein a coating is arranged on an inner wall of each of the plurality of through holes; and the coating has a property of swelling upon contact with water.

* * * * *